United States Patent [19]

Popper

[11] 4,211,441

[45] Jul. 8, 1980

[54] SPRING CLASP

[75] Inventor: Jakhin B. Popper, Kyriat Motzkin, Israel

[73] Assignee: Popper Engineering Ltd., Kyriat Motzkin, Israel

[21] Appl. No.: 911,179

[22] Filed: May 31, 1978

[30] Foreign Application Priority Data

Jun. 6, 1977 [IL] Israel ..... 52260

[51] Int. Cl.[2] ..... E05C 19/06

[52] U.S. Cl. ..... 292/259 R; 292/DIG. 30

[58] Field of Search ..... 292/259, DIG. 30, DIG. 49

[56] References Cited

U.S. PATENT DOCUMENTS

| | | | |
|---|---|---|---|
| 485,011 | 10/1892 | Kneeland | 292/259 |
| 725,276 | 4/1903 | McMenimen | 292/259 X |
| 2,559,681 | 7/1951 | Senseman | 292/DIG. 30 |
| 2,715,540 | 8/1955 | Potter | 292/241 |
| 2,752,200 | 6/1956 | Santarelli | 292/259 X |

*Primary Examiner*—Richard E. Moore

*Attorney, Agent, or Firm*—Browdy and Neimark

[57] ABSTRACT

Over-center closure apparatus comprising an elongate element configured to define a central region having a first length; first and second intermediate regions arranged in a first plane having respective third and fourth lengths and being angularly disposed with respect to the central region; and first and second end regions adapted to be rotatably secured to a member and forming respective first and second vertices with the outer ends of the first and second intermediate regions and having respective fourth and fifth lengths and being disposed at an acute angle with respect to the axis joining said first and second vertices.

10 Claims, 9 Drawing Figures

SPRING CLASP

The present invention relates to locks and securing devices which involve motion over-center during locking and unlocking thereof.

A wide variety of over-center type locks are well known in the art for producing a snap action securing function. The present invention seeks to provide spring closure apparatus employing an over-center locking movement which is of high capacity and strength due to particular structural features which are described in detail hereinafter.

There is thus provided in accordance with an embodiment of the invention over-center closure apparatus comprising an elongate element configured to define:

a central region having a first length;

first and second intermediate regions arranged in a first plane having respective third and fourth lengths and being angularly disposed with respect to said central region; and first and second end regions adapted to be rotatably secured to a member and forming respective first and second vertices with the outer ends of said first and second intermediate regions and having respective fourth and fifth lengths and being disposed at an acute angle with respect to the axis joining said first and second vertices.

In accordance with a preferred embodiment of the invention the end regions are disposed at an acute angle with respect to said axis both in said first plane defined by the intermediate regions and in a plane perpendicular to said first plane.

Additionally in accordance with an embodiment of the invention the intermediate regions are bowed inwardly with respect to the central region in said first plane.

Further in accordance with a preferred embodiment of the invention there are also provided first and second angled intermediate regions which join the respective first and second intermediate regions to the central region which lies above first plane.

The invention will be more fully understood and appreciated from the following detailed description taken in conjunction with the drawings in which.

Figure 1:
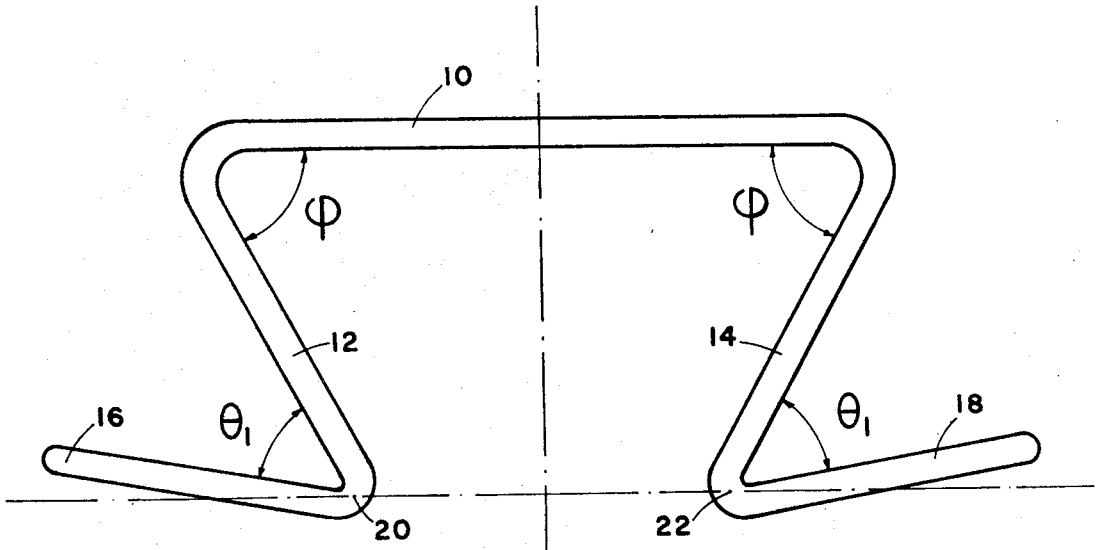
FIG. 1 is a planar view of a securing device constructed and operative in accordance with an embodiment of the invention.
Figure 2:
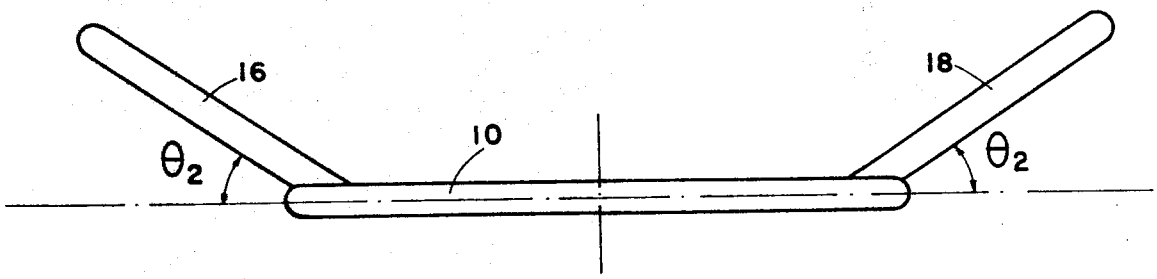
FIG. 2 is a side view of the device of FIG. 1.

Referring now to FIGS. 1 and 2 there is seen a device which is operative, when suitably mounted, to secure a surface or like element in a desired orientation. The device typically comprises a bent steel wire configured to define a central generally elongate section 10 and first and second intermediate sections 12 and 14 arranged generally coplanar with section 10 and angularly disposed with respect thereto by an angle and angularly disposed with respect thereto by an angle $\phi$. First and second intermediate sections 12 and 14 terminate in respective cantilever ends 16 and 18 which are disposed at an acute angle thereto and define therewith first and second vertices 20 and 22. Cantilever ends 16 and 18 are disposed at an angle $\theta_1$ with respect to the axis joining the first and second portions in the plane defined by sections 10, 12 and 14, hereinafter referred to as the "first plane". Cantilever ends 16 and 18 are also angled with respect to the first plane by an acute angle $\theta_2$.

According to a preferred embodiment of the invention the device is constructed generally symmetrically such that the length and angular dispositions of intermediate sections 12 and 14 are identical as are the length and angular dispositions of cantilever ends 16 and 18. It is appreciated however that angles $\theta_1$ and $\theta_2$ need not be equal although this may also be desirable.

Figure 3:
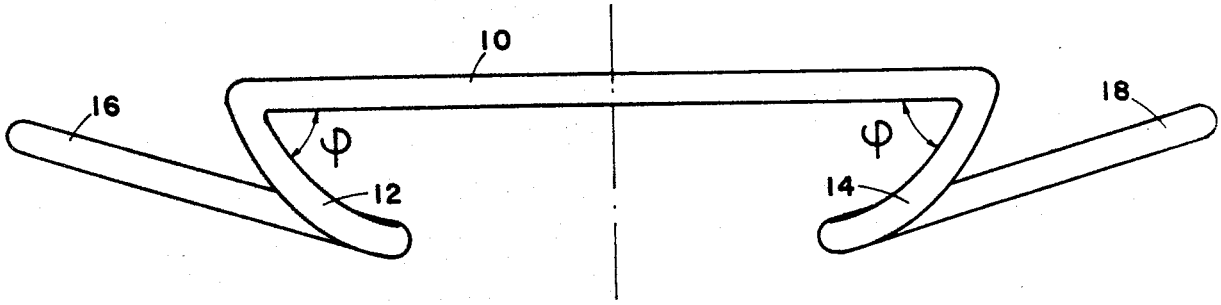
FIG. 3 is a side view of a closure device constructed and operative in accordance with an alternative embodiment of the invention.
Figure 6:
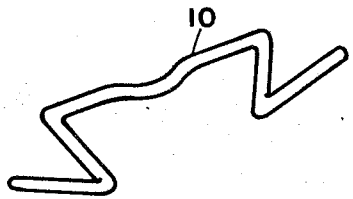
FIG. 6 is a pictorial illustration of a modified form of the device of FIG. 1.

An alternative embodiment of the device illustrated in FIGS. 1 and 2 is shown in FIG. 3 in which embodiment intermediate sections 12 and 14 of the embodiment of FIG. 1 are bent approximately midway along their respective lengths such that central section 10 and the portions of intermediate sections 12 and 14 adjacent thereto lie in a second plane angled with respect to the first plane in which lie the lower portions of intermediate sections 14 and 12. The advantage of this configuration is that it permits relatively easy access for grasping of section 10 by a human hand even when the device is positioned in a locking engagement against a surface. Another alternative configuration of the device is illustrated in FIG. 6. Here the device illustrated in FIG. 1 is modified such that section 10 is bowed intermediate along its length to provide a niche under which a finger or other lever may be inserted for lifting of section 10 and subsequent rotation of the entire device.

Figure 7:
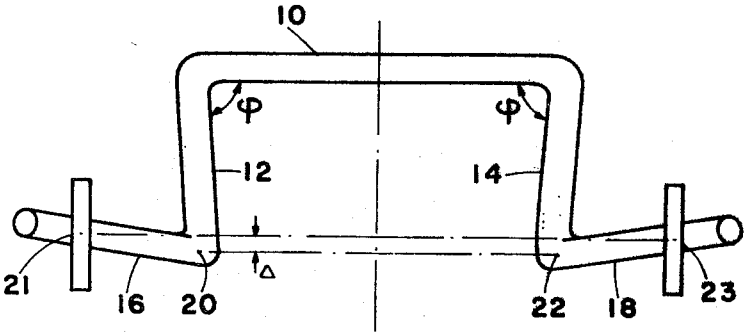
FIG. 7 is a schematic illustration of the device of FIG. 3 in a mounted configuration.

Reference is now made to FIG. 7 which shows a schematic illustration of the device of FIG. 3 in a mounted orientation wherein the respective regions 16 and 18 are rotatably secured at positions 21 and 23, respectively.

Figure 4:
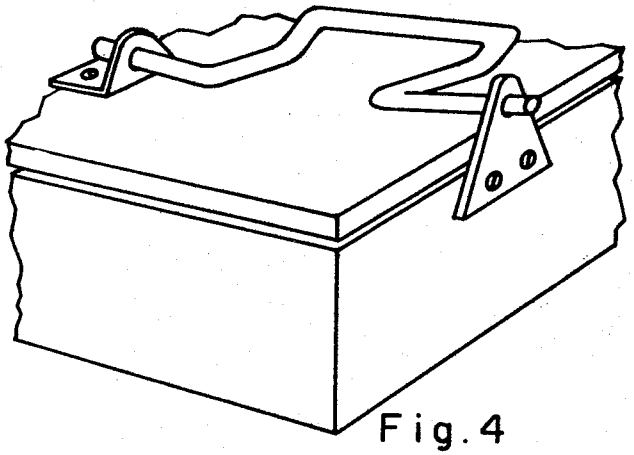
FIG. 4 is a pictorial illustration of the device of FIG. 3 in a locking configuration.

It is to be appreciated that mounting of the device as illustrated in FIGS. 4 and 7 must be done such that a cantilever force is exerted on regions 16 and 18 about respective vertices 20 and 22 perpendicular to the first plane. This in turn results in the application of a torsion force to regions 12 and 14. It is appreciated that the spring action is produced by a moment $M=\Delta \cdot F$ where $\Delta$ is the separation of the line between the vertices 20 and 22 and the line joining the center points of the elongate element at its mounting locations 21 and 23, and F is the force required to produce the snap action.

It is appreciated that once the device has been rotated into a locked position as illustrated in FIG. 4, rotation back to an unlocked position is restrained by the moment $M=\Delta \cdot F$ since rotation of the device about vertices 20 and 22 would cause an increased force on mounting supports 26 and 27. Intermediate sections 12 and 14 function as torsion bars producing a generally uniform bending moment over the entire length of section 10. In order to maximise the ratio of the length of section 10 to the length of the cantilever regions 16 and 18 the overlap configuration illustrated in the Figures is employed such that the angle $\phi$ defined between section 10 intermediate sections 12 and 14 is selected to be acute. The increased length of section 10 as compared with the length of cantilever ends 16 and 18 is selected to increase the amount of deformation produced with a minimum amount of force and minimum material fatigue.

Figure 5:
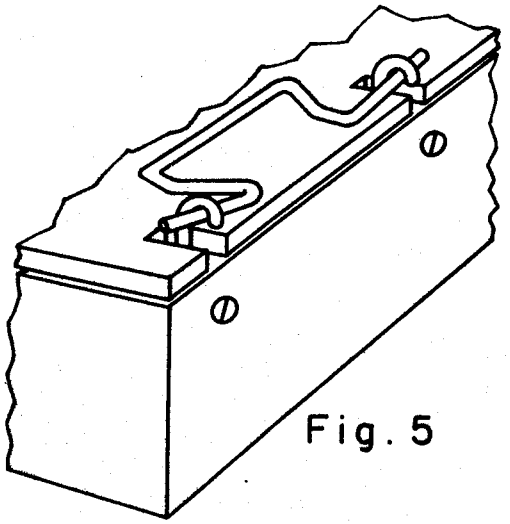
FIG. 5 is a pictorial illustration of the device of FIG. 3 in an alternative locking configuration.
Figure 8:
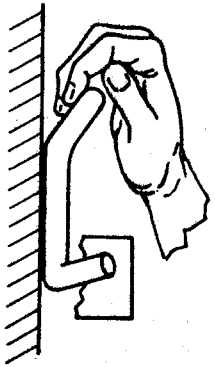
FIG. 8 is a side view illustration of the device of FIG. 7 in a mounted configuration.

Reference is now made to FIGS. 5 and 8 which show an alternative means of mounting wherein both mounting hooks are fixed to a container whose cover it is desired to secure thereagainst. In the embodiment of FIGS. 5 and 6 twice the force is exerted on the cover as compared with the embodiment of FIG. 4.

Figure 9:
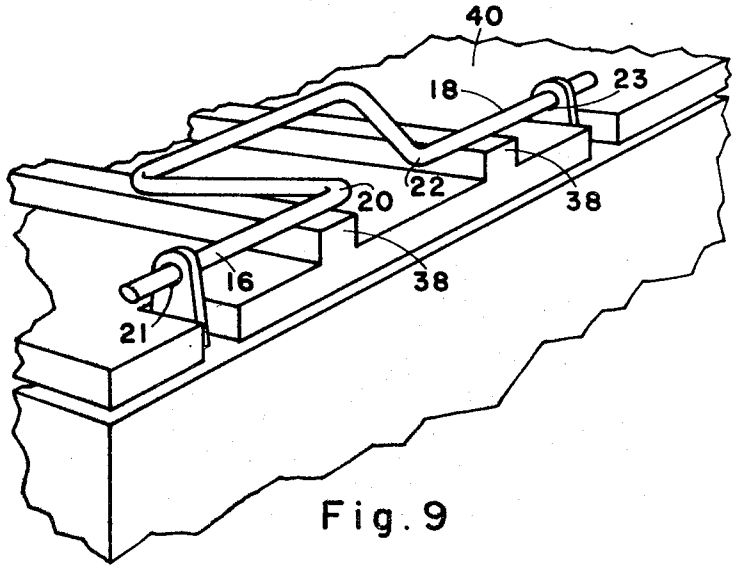
FIG. 9 is a pictorial illustration of an alternative form of closure device.

Referring now to FIG. 9 there is seen yet another embodiment of a locking device constructed and operative in accordance with an embodiment of the invention. Here the element is constructed to be identical to that illustrated in FIG. 1 but entirely uniplanar and the member sought to be secured is configured so as to provide raised supports 38 for the cantilever members 16 and 18 adjacent respective vertices 20 and 22 and at a height which exceeds the height of the cantilever ends of respective mounting supports 21 and 23. Thus a reaction force is produced on raised supports 38 and thus on the cover member 40 which force increases with rotation of the device about the axis defined by the line extending through mounting locations 21 and 23 from the locked position illustrated.

An exemplary embodiment of an over-center locking element similar to that illustrated in FIGS. 1 and 3 herein was constructed of a rod of 7 mm diameter spring steel SAE 1080. The length of the center region was 145 mm and the length of each of the second intermediate regions was 83 mm. The angle $\phi$ was selected to be 65°. The cantilever end regions were selected to be each of length 76.5 mm. The angle $\theta_1$ between the intermediate region and the end region in the first plane was selected to be 4° while the angle $\theta_2$ between the first plane and the cantilever end regions was selected to be 7.5°. The element when mounted produces a stress of 45.4 kgs. per mm and a torsion sheer stress of 22.7 kgs. per mm.

In this embodiment $\theta_1$ may be selected to be any suitable value as in the embodiment of FIG. 1. However, $\theta_2$ is selected to be 0.

It will be appreciated by persons skilled in the art that many alternative embodiments within the scope of the present invention may also occur. The embodiments which have been specifically shown and described herein are merely exemplary and do not limit the scope of the invention which is defined only by the claims which follow:

I claim:

1. An over-center fastening device for fastening a first member in a predetermined orientation with respect to a second member comprising:

an elongated element having a central region, constituting a handle, of a first length;

first and second intermediate regions arranged in a first plane having respective second and third lengths and being angularly disposed with respect to the central region; and first and second end regions forming respective first and second vertices with the outer ends of the first and second intermediate regions and having respective fourth and fifth lengths disposed at an acute angle with respect to the axes joining the first and second vertices;

said device further comprising a pair of pivotal support means at least one of which is formed integrally with a second member for pivotally supporting said end regions at a predetermined height above a surface of said first member so as to permit pivotal displacement of said elongated element and so that said element exerts a force at said first and second vertices on said surface when in engagement therewith.

2. A device according to claim 1 wherein one support means is formed integrally with a first member and one support means is formed integrally with a second member.

3. A device according to claim 1 wherein both said support means are formed integrally with said second member.

4. A device according to claim 1 wherein said end regions are disposed at an acute angle with respect to said axis in said first plane.

5. A device according to claim 1 wherein said end regions are disposed at an acute angle with respect to said axis in a plane perpendicular to said first plane.

6. A device according to any of claims 1, 4 or 5 wherein said first and second intermediate regions are arranged in the same plane as the central region.

7. A device according to claim 1 wherein said first and second intermediate regions are arranged in a plane different from that of said central region.

8. A device according to claim 1 wherein said intermediate regions are bowed with respect to the central region in said first plane.

9. A device according to claim 7 and also comprising first and second angled intermediate regions which join the respective first and second intermediate regions to the central region.

10. A device according to claim 1 wherein said surface is configured to have raised portions which bias said end portions so as to cause said elongated element to exert a force thereon.

* * * * *